US005812587A

United States Patent [19]

Locatelli

[11] Patent Number: 5,812,587

[45] Date of Patent: Sep. 22, 1998

[54] APPARATUS AND METHOD FOR THE SUPPLY OF MOLTEN METAL

[75] Inventor: Jeremy Robin Locatelli, Tasmania, Australia

[73] Assignee: Comalco Aluminium Limited, Victoria, Australia

[21] Appl. No.: 793,923

[22] PCT Filed: Sep. 20, 1995

[86] PCT No.: PCT/AU95/00616

§ 371 Date: Jun. 5, 1997

§ 102(e) Date: Jun. 5, 1997

[87] PCT Pub. No.: WO96/09511

PCT Pub. Date: Mar. 28, 1996

[30] Foreign Application Priority Data

Sep. 20, 1994 [AT] Austria ..... PM8300

[51] Int. Cl.[6] ..... F27D 3/00

[52] U.S. Cl. ..... 373/79; 373/81; 373/84; 373/115; 373/143; 266/15; 266/45; 266/242

[58] Field of Search ..... 373/81, 78, 79, 373/84, 115, 142, 143; 266/15, 34, 45, 242

[56] References Cited

U.S. PATENT DOCUMENTS

| | | | |
|---|---|---|---|
| 3,747,912 | 7/1973 | Wernii | 266/34 |
| 3,898,365 | 8/1975 | Antoine et al. | 13/10 |
| 4,433,421 | 2/1984 | Wooding | 373/79 |
| 5,559,827 | 9/1996 | Shimada et al. | 373/142 |

FOREIGN PATENT DOCUMENTS

| | | |
|---|---|---|
| 3656863 | 10/1963 | Australia . |
| 65613/65 | 10/1965 | Australia . |
| 51505/69 | 3/1969 | Australia . |
| 947563 | 8/1962 | United Kingdom . |
| 1390636 | 4/1972 | United Kingdom . |

*Primary Examiner*—Tu B. Hoang
*Attorney, Agent, or Firm*—Nikaido Marmelstein Murray & Oram, LLP

[57] ABSTRACT

The present invention is concerned with an apparatus for supply of molten metal including a holding furnace pivotable about an axis having a metal chamber for holding molten metal, an outlet for supplying molten metal from said chamber and an inlet well communicating with said metal chamber, said inlet well being positioned on or adjacent the pivot axis of the holding furnace and displaced along the pivot axis from said outlet, a charging means for intermittently supplying a controlled flow of molten metal to the inlet well of the holding furnace, and a control means for varying the degree of pivot of the holding furnace to maintain a predetermined supply of molten metal. Also claimed as a holding furnace for the supply of molten metal, and a method for supplying molten metal using such apparatus.

31 Claims, 5 Drawing Sheets

APPARATUS AND METHOD FOR THE SUPPLY OF MOLTEN METAL

BACKGROUND OF THE INVENTION

1. Field of the Invention

This invention relates to the supply of molten metal from a holding furnace to a casting launder and in particular to an apparatus and process which enables the supply of molten metal to continue while the holding furnace is being recharged. The invention also relates to a process for refilling the holding furnace of the invention and the batch operation of the apparatus.

2. Description of the Related Art

During the casting of molten metals such as aluminium, a holding furnace is tilted to maintain a constant level in the casting launder. The level in the launder is usually automatically controlled by sensing the launder metal level and tilting the furnace by adjusting the flow of hydraulic fluid to the furnace tilting cylinder(s).

In conventional arrangements where the holding furnace is filled by pouring, a charging port shaped like an angled funnel is often used to direct the molt metal poured from a spout on the transport crucible through the furnace wall above the maximum metal level. Where the furnace is filled by siphoning, the siphon pipe is usually suspended from an overhead hoist with the delivery leg of the pipe passing through a hole in the wall of the furnace above the maximum metal level. Where a charging port is employed, it is usually located to suit the delivery point of the transport crucible and to avoid furnace equipment such as burners and access doors. This type of conventional charging arrangement will not normally permit the furnace to be tilted during a charging operation. While the furnace is continually tilting about the tilt axis during the casting operation, it is technologically difficult and would require complex equipment to be able to charge fresh molten metal to the holding furnace during a casting operation.

Consequently, once the holding furnace is emptied, it is returned to its upright position and refilled by either pouring or as has been suggested, siphoning molten metal from the potline crucible which supplies molten metal.

To provide a casting operation with a continuous supply of molten metal, it is necessary to have two holding furnaces arranged to feed into a common launder system. While this results in a duplication of supply apparatus, and increased capital cost, it allows one furnace to supply the casting operation, while the other furnace is being filled.

SUMMARY OF THE INVENTION

It is an object of the present invention to provide a method of supplying molten metal and an apparatus for the supply of molten metal which enables intermittent charging while maintaining a constant supply of molten metal to the casting process.

Accordingly, the invention provides a method of supplying molten metal including the steps of providing a holding furnace for molten metal pivotable about a pivot axis, tilting said holding furnace about the pivot axis for the supply of molten metal to a casting process from an outlet in the holding furnace via a launder, intermittently charging a controlled flow of molten metal to an inlet well communicating with a metal chamber in the holding furnace and positioned on the holding furnace on or adjacent to the pivot axis of the holding furnace, the inlet well being axially displaced along the pivot axis from the outlet of the holding furnace and controlling the tilting of the holding furnace to maintain the level of molten metal in the launder at a predetermined level.

By maintaining the level of molten metal in the launder at a predetermined level, a constant supply of molten metal can be maintained to the casting process.

Preferably the tilting of the holding furnace is controlled by monitoring the level of molten metal in the launder and adjusting the tilt angle of the holding furnace to maintain a predetermined level of molten metal in the casting launder.

In a preferred form of the invention, the molten metal is charged into the inlet well of the holding furnace from a crucible. The level of molten metal in the crucible is preferably above the level of molten metal in the inlet well to enable the metal to be transferred from the crucible to the inlet well by a conduit. The conduit is preferably shaped like an inverted "U" with the receiving leg being shorter than the discharge leg.

To effect the transfer of molten metal, the receiving leg of the conduit is preferably lowered into a transport crucible whilst the discharge leg is placed into the furnace inlet well. Both legs of the conduit preferably remain submerged in molten metal and the metal level in the crucible must remain above the metal level in the furnace during the transfer process.

In this way, the curved section of the U-shaped conduit forms a weir in which the molten metal must rise up the receiving leg into the curved section above the weir point before being able to flow down the discharge leg of the conduit into the furnace inlet well. To cause the molten metal to rise up the conduit, a vacuum is applied to the conduit by the connection of a vacuum line to a tapping in the curved section of conduit. Provided the curved section of conduit does not completely fill with molten metal, the flow rate of the molten metal may be controlled by controlling the vacuum in the conduit. Once the curved section of conduit completely fills with molten metal, the conduit acts as a conventional siphon and the flow rate is then governed by the head of molten metal and the flow parameters of the conduit, resulting in the flow becoming uncontrollable.

Further detail of the operation and control of the metal transfer conduit is provided in International publication WO96/06319, entitled "Transfer of Molten Metal"; the whole contents of which are incorporated herewith by reference.

The transfer conduit is preferably aligned substantially co-planer with the pivot axis of the holding furnace. During transfer, the position of the transfer conduit relative to the holding furnace is fixed so that the whole of the conduit pivots about the pivot axis of the holding furnace. Since the supply crucible is stationary during metal transfer and does not pivot with the holding furnace, it is preferable that the transfer conduit is free to move within the crucible to compensate for the tilting movement of the holding furnace and transfer conduit during charging of the holding furnace relative to the stationary crucible.

Another aspect of the invention provides an apparatus for the supply of well being positioned on or adjacent the pivot axis of the holding furnace and displaced along the pivot axis from said outlet, a charging means for intermittently supplying a controlled flow of molten metal to the inlet well of the holding furnace, and a control means for varying the degree of pivot of the holding furnace to maintain a predetermined supply rate of molten metal.

To ensure that the discharge leg of the conduit remains submerged during metal transfer it is preferable that the base of the inlet well is positioned below the level of the molten metal in the metal chamber throughout the full range of pivotal motion of the furnace.

Preferably the above apparatus further comprises a furnace tilt hoist for raising or lowering one side of the holding furnace causing the furnace to pivot about the pivot axis. In its preferred form the tilt hoist is an hydraulic cylinder.

The control means may include a control device which continuously monitors a signal from a level sensor in the launder, the control device causing the tilt hoist to adjust the degree of tilt of the holding furnace to maintain the molten metal in the launder at a predetermined level.

The applicants have found that by controlling the transfer of molten metal to limit the flow rate into the inlet well of the holding furnace, additional advantages of the invention such as reduced dross formation can be realised.

In the preferred form of the invention, the charging means for intermittently supplying a controlled flow of molten metal to the inlet well of holding furnace may be a transfer conduit supplying molten metal from a removable supply vessel.

The position of the conduit relative to the holding furnace and inlet well is preferably fixed during charging and is aligned in line with the pivot axis of the holding furnace. In this way, there is no relative movement of the conduit in the inlet well of the holding furnace as the furnace goes through its tilt cycle. However, since there is relative movement between the crucible and the end of the transfer conduit, the crucible is preferably positioned to enable relative movement of the conduit without affecting the transfer of molten metal and to avoid contact between the conduit and the crucible.

The conduit is preferably shaped like an inverted "U" with the receiving leg conduit, the crucible is preferably positioned to enable relative movement of the conduit without affecting the transfer of molten metal and to avoid contact between the conduit and the crucible.

The conduit is preferably shaped like an inverted "U" with the receiving leg being shorter than the discharge leg. To effect transfer of the molten metal from the crucible, the receiving leg of the conduit is preferably lowered into a crucible whilst the discharge leg is placed into the furnace inlet well. Molten metal is drawn up the receiving leg of the conduit above the level of molten metal in the crucible preferably by connection of a tapping in the "U" or curved section of the conduit to a vacuum line and applying a vacuum in the conduit. The level of molten metal in the crucible is preferably above the level of molten metal in the inlet well to enable transfer to be effected.

As long as the "U" or curved section of the conduit is not completely filled with molten metal, the "U" or curved section functions as a weir and the flow rate of molten metal over the weir can be controlled by adjusting the vacuum in the conduit.

As discussed earlier, further details of the apparatus and operation for transferring molten metal in a transfer conduit are disclosed in the above-mentioned International Publication WO96/06319.

The present invention enables the holding furnace to be charged while maintaining a supply of molten metal to an operation such as a casting operation. Therefore only one holding furnace is required per casting station. Additionally, dross formation is reduced by the preferred form of the invention thereby compounding the cost savings of the invention.

The invention in a further aspect provides a holding furnace for the supply of molten metal including a tilt hoist for tilting the furnace about a pivot axis, a metal chamber for holding molten metal, an outlet for supplying molten metal from said metal chamber, said outlet being positioned on or about the pivot axis, and an inlet well for intermittently receiving molten metal from a molten metal source, said inlet well communicating with said metal chamber to enable molten metal to flow to said drawings in which.

DESCRIPTION OF THE PREFERRED EMBODIMENTS

Figure 1:
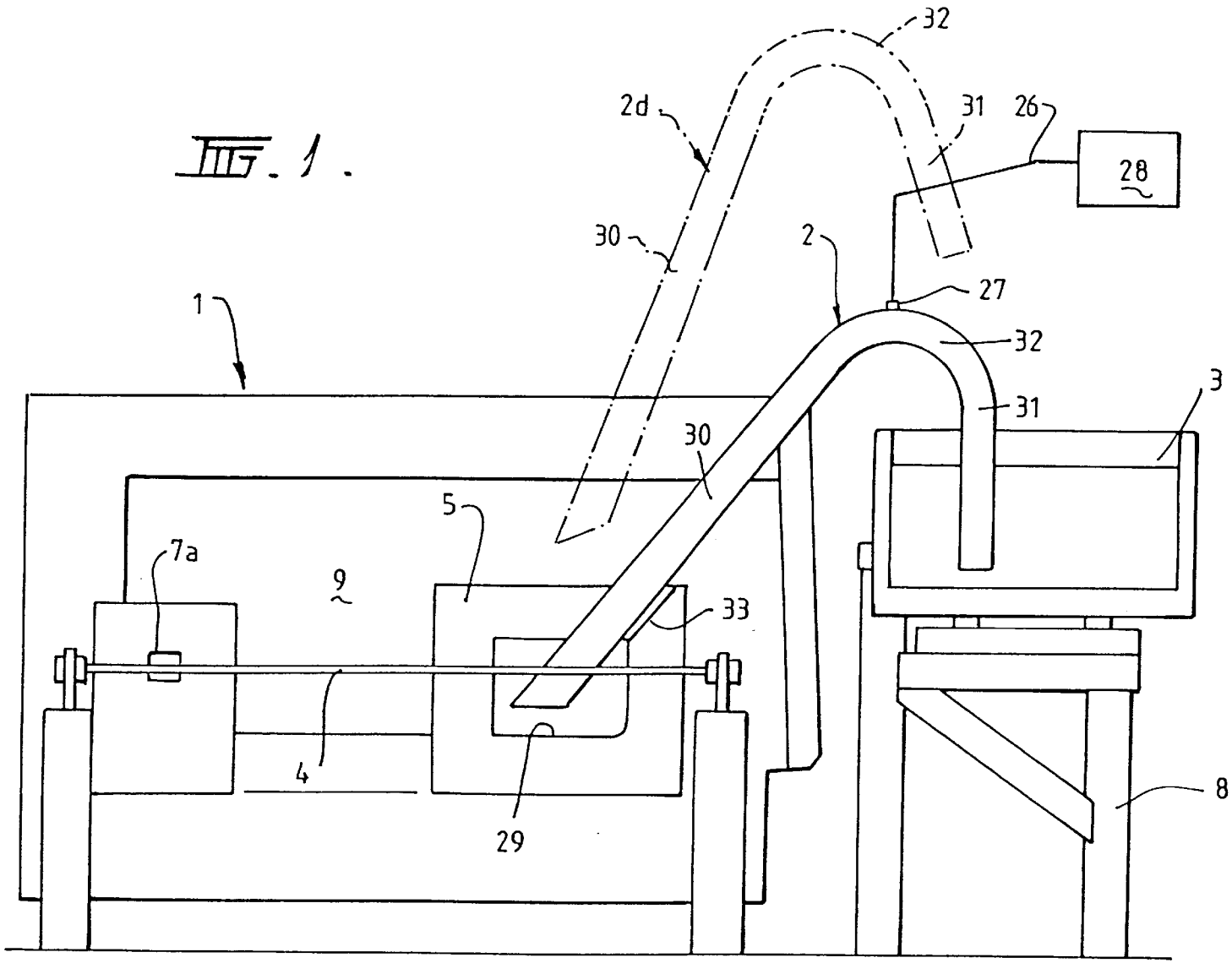
FIG. 1 is a front schematic view of a preferred embodiment of the invention.
Figure 2:
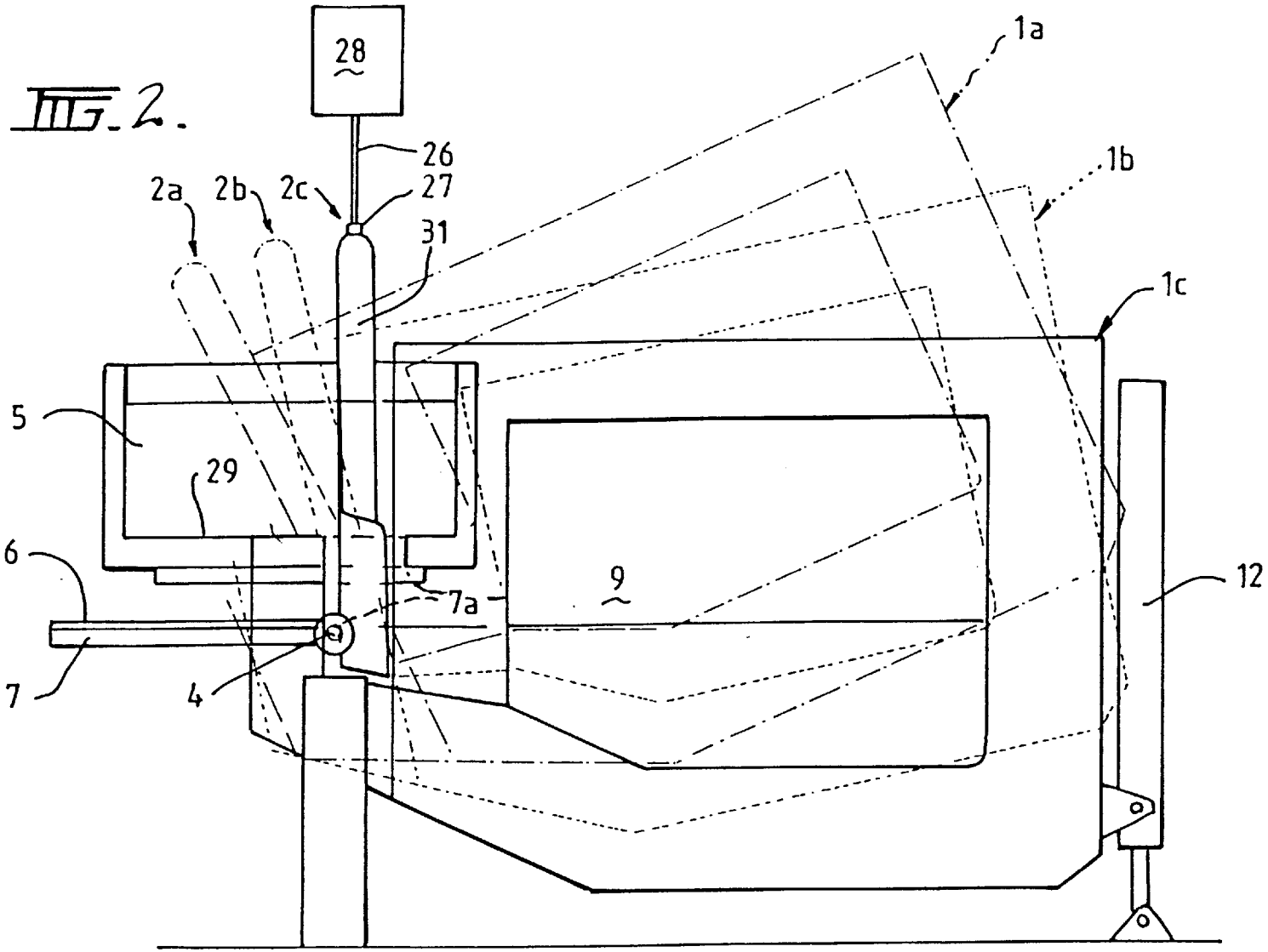
FIG. 2 is a side view of the preferred embodiment shown in FIG. 1.

Referring to the drawings, a holding furnace 1 (which is also designated 1*a,* 1*b,* 1*c* in the various positions shown in FIG. 2) is shown including a metal chamber 9 for holding molten metal, an outlet 7*a* for the supply of molten metal to a casting launder 7 (not shown in FIG. 1) and an inlet well 5 communicating with metal chamber 9. The holding furnace is tiltable about a pivot axis 4 to ensure that sufficient molten metal flows into the casting launder to maintain the level of molten metal in the launder at a predetermined height. An hydraulic cylinder 12 (not shown in FIG. 1) is provided on the opposite side of the furnace 1 to the pivot axis 4 to adjust the pivot angle of the holding furnace 1 and the inlet well 5 positioned on or adjacent the pivot axis 4 of the holding furnace 1. As a consequence of the positioning of the inlet well 5, the movement of the inlet well during the range of pivotal movement of the holding furnace is minimized.

The outlet 7*a* is preferably also positioned on or adjacent the pivot axis 4 of the holding furnace and arranged to communicate with the metal chamber 9 so that raising or lowering of the furnace tilt angle causes the level of molten metal in the launder 7 to rise or fall accordingly. To ensure that the motion of molten metal entering inlet well 5 does not excessively disturb the level readings in the launder 7, the inlet well 5 is axially displaced along the pivot axis 4 from the outlet 7*a,* and are preferably positioned at opposite ends of metal chamber 9.

During charging of the holding furnace, a charging means supplies molten metal to the inlet well 5. In a preferred form of the invention, the charging means is a transfer conduit 2 (which is also designated 2*a,* 2*b,* 2*c,* 2*d,* in the various positions shown in FIGS. 1 and 2), the upper end of which is below the level of molten metal in a molten metal crucible 3, seen only in FIG. 1. The transfer conduit 2 is arranged so as to be within the same plane as the pivotal axis 4 of the holding furnace 1. In this way, movement of the lower end of the conduit 2*a,* 2*b,* 2*c* in the inlet well 5 is minimized and movement of the upper end of the conduit 2*a*,2*b*,2*c* is rotational about the pivot axis in a single direction. Preferably the transfer conduit 2 rises above the level of molten metal in the crucible 3 to form a curved section 32 which descends into the molten metal of the crucible.

To transfer the molten metal using the transfer conduit 2, the vacuum in the conduit is increased by engaging a vacuum line 26 which, is in turn connected to a vacuum pump 28, to a pressure tapping 27 in the curved section 32 of the conduit. Since both ends of the conduit 2 are below the respective levels of the molten metal, molten metal from the crucible 3 rises up the conduit 2. As the molten metal rises up the conduit 2, the curved section 32 of the conduit 2 functions as a weir and because the level in the furnace is below that in the crucible, the metal flows from the crucible 3 to the furnace inlet well 5. To maintain a flow of molten metal over the weir, the vacuum in the conduit 2 is increased accordingly. Consequently the flow of molten metal from the crucible 3 to the furnace inlet well 5 can be controlled by adjusting the vacuum within the curved section of the conduit 2.

Once the crucible 3 has been emptied, the transfer conduit 2 can be raised to the position 2*d* to permit another crucible to be moved into position.

The inlet well 5 of the holding furnace 1 is basically rectangular in shape. The width of the inlet well 5 should be no wider than necessary but sufficient to allow the transfer conduit 2 to enter with some clearance to avoid contact with the refractory wall 28, even when the transfer conduit 2 has accumulated a build-up of dross.

The length of the inlet well 5 is sufficient to allow the transfer conduit 2 to reach the bottom of the well 5, when the transfer conduit is lowered on its pivoting arm (not shown). At one end of the well 5, where the sloping discharge leg of the transfer conduit 2 passes over the well wall, the refractory wall (best seen in FIG. 1) to a height which is above the molten metal level can be shaped to match the slope of the conduit 2, permitting the length of the inlet well to be reduced. The sloping refractory 29 should only occur above the metal so that the full refractory thickness is available beneath the molten metal. The depth and shape of the inlet well bottom 29 is important to enable the discharge end of the transfer conduit 2 to always remain well covered during the transfer operation and also allow the furnace to be almost completely emptied whilst leaving a small sump of molten metal with a sufficient volume to restart the transfer operation. The inlet well bottom 29 should also be flat and sloped towards the furnace hearth so that it can be cleaned easily when the furnace is lowered. The depth of the inlet well bottom 29 should also preferably be made so that it is dry when the furnace is fully lowered and when the furnace is itself about half full. This ensures that the extent of any dross and pot bath build-up is visible and easy to clean when the furnace is fully lowered.

The transfer conduit 2 is shaped like an inverted "U" with the inlet leg 31 vertical and the outlet leg 30 sloped at a suitable angle, preferably about 45°. The conduit may be made from a single piece of cast iron and mounted on a separate rigid steel support arm (not shown) which enables the conduit 2 to be raised and lowered simultaneously into the furnace inlet well 5 and the potline crucible 3 by a hoist (not shown) mounted on the furnace. The transfer conduit 2 is guided against the front face of the furnace during raising and lowering by means of a guide arm mechanism (not shown) which limits lateral movement of the transfer conduit support arm.

To charge the furnace 1 while casting is in progress, a crucible 3 is placed on a fixed stand 8 (seen only in FIG. 1) located beneath the transfer conduit inlet leg. When the transfer conduit support arm (not shown) is lowered, the transfer conduit inlet leg 31 is submerged in the crucible 3 to a depth of about 50 mm above the bottom of the crucible, whilst the outlet leg 30 is about 50 mm above the bottom 29 of the furnace inlet well 5. When in this position, the centerline of the siphon inlet leg 31 intersects the furnace pivot axis 4 so that the pivot axis 4 and the siphon are co-planar. This geometry is most preferable. In order to obtain an adequate metal flow, the crucible bottom should be at least 300 mm above the furnace metal level during casting. In the charging position, the vertical distance between the bottom of the conduit inlet leg 31 and the furnace pivot axis 4 should be minimized to limit vertical travel of the transfer conduit inlet during furnace tilt-back as charging takes place.

Furnace Tilt Control

Figure 3:
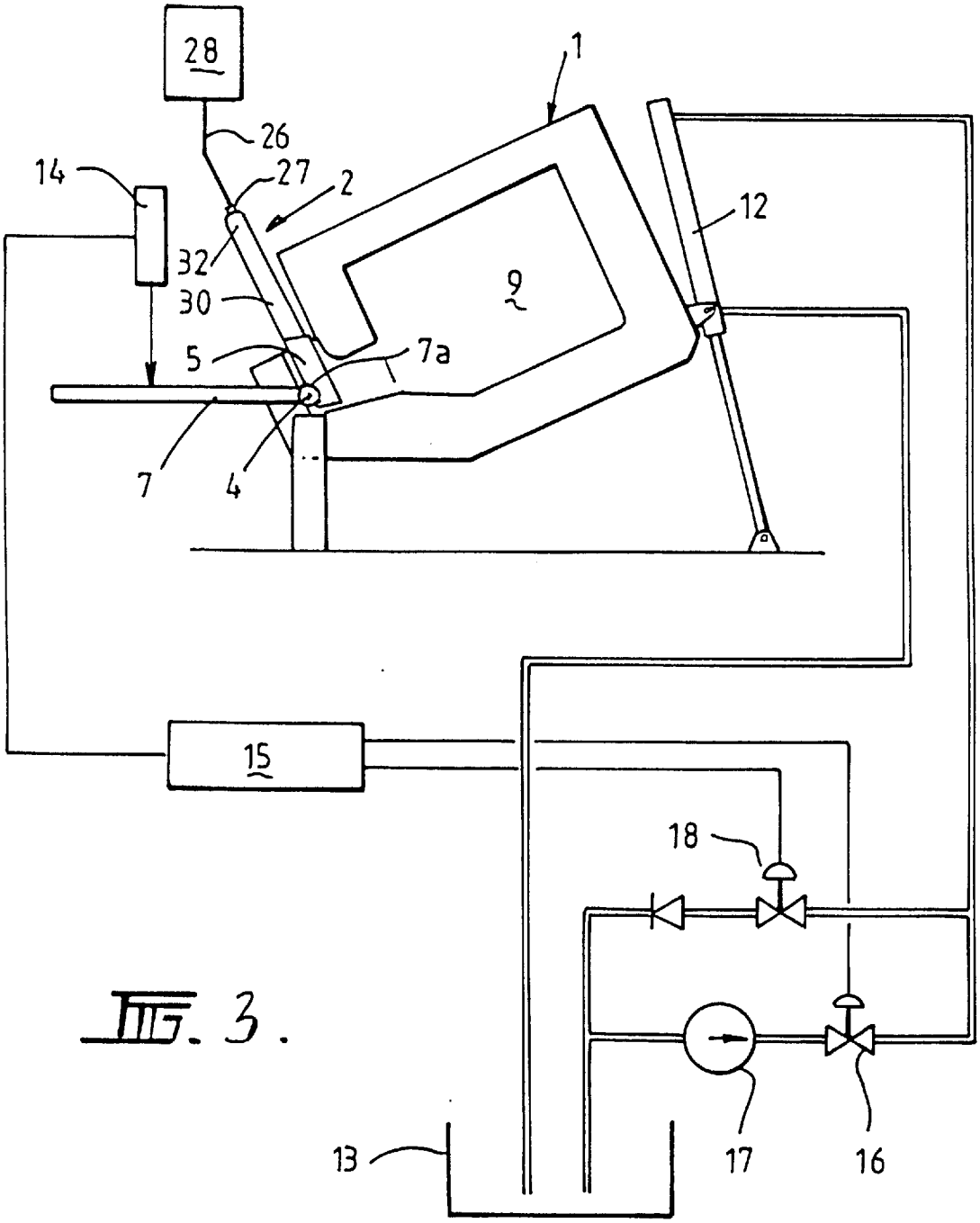
FIG. 3 is a schematic view of the holding furnace tilt control.

The furnace tilt control mechanism is shown in FIG. 3, the operation of which will be described below with reference to FIG. 3.

During casting, the furnace 1 is tilted upwards gradually to maintain the level in the casting launder 7 at a constant level. This is done by controlling the hydraulic oil flow supplied to the furnace tilt cylinder 12 from hydraulic fluid reservoir 13.

A sensing device 14 which can produce an electronic signal proportional to the launder level delivers its signal to a control device such as a process computer 15 which manages a proportional feedback loop. The output signal from this control loop operates a proportional valve 16 in the furnace hydraulic circuit which delivers hydraulic oil supplied from a small hydraulic pump 17 to the furnace tilt cylinder 12. This proportional feedback control loop is referred to as the casting control loop.

A second proportional feedback loop controls the furnace tilt during charging. This loop receives input from the same metal level sensor 14 used in the casting control loop. This control loop is referred to as the charging control loop, the output of which controls a second proportional hydraulic valve 18 which affects the return of hydraulic oil from the furnace tilt cylinder to the hydraulic oil reservoir 13, thus controlling lowering of the furnace under its own weight.

During casting, only the casting control loop is active, the charging loop being inhibited. When it is required to charge molten metal into the furnace 10, the charging loop is made active and the casting loop inactive. This is handled reliably by the process computer 15 using the combination of two input signals. The first signal is the pressing of a button to initiate the charging operation by the process operator, and the second signal is when a small rise in the launder metal level is detected by the level sensor 14.

The charging control loop remains active until the end of the metal transfer. The end of the metal transfer is determined by the process computer 15 when a sudden loss of vacuum in the transfer conduit 12 is detected by a pressure transducer. The sudden loss of vacuum indicates that air is being drawn through the inlet leg of the transfer conduit, signifying that the supply crucible (not shown) has been emptied. At the end of the metal transfer, the process computer 15 deactivates the charging control loop and reactivates the casting control loop.

During the charging operation the casting launder level remains substantially constant. Thus the casting process can continue without interruption or significant variation.

Figure 4:
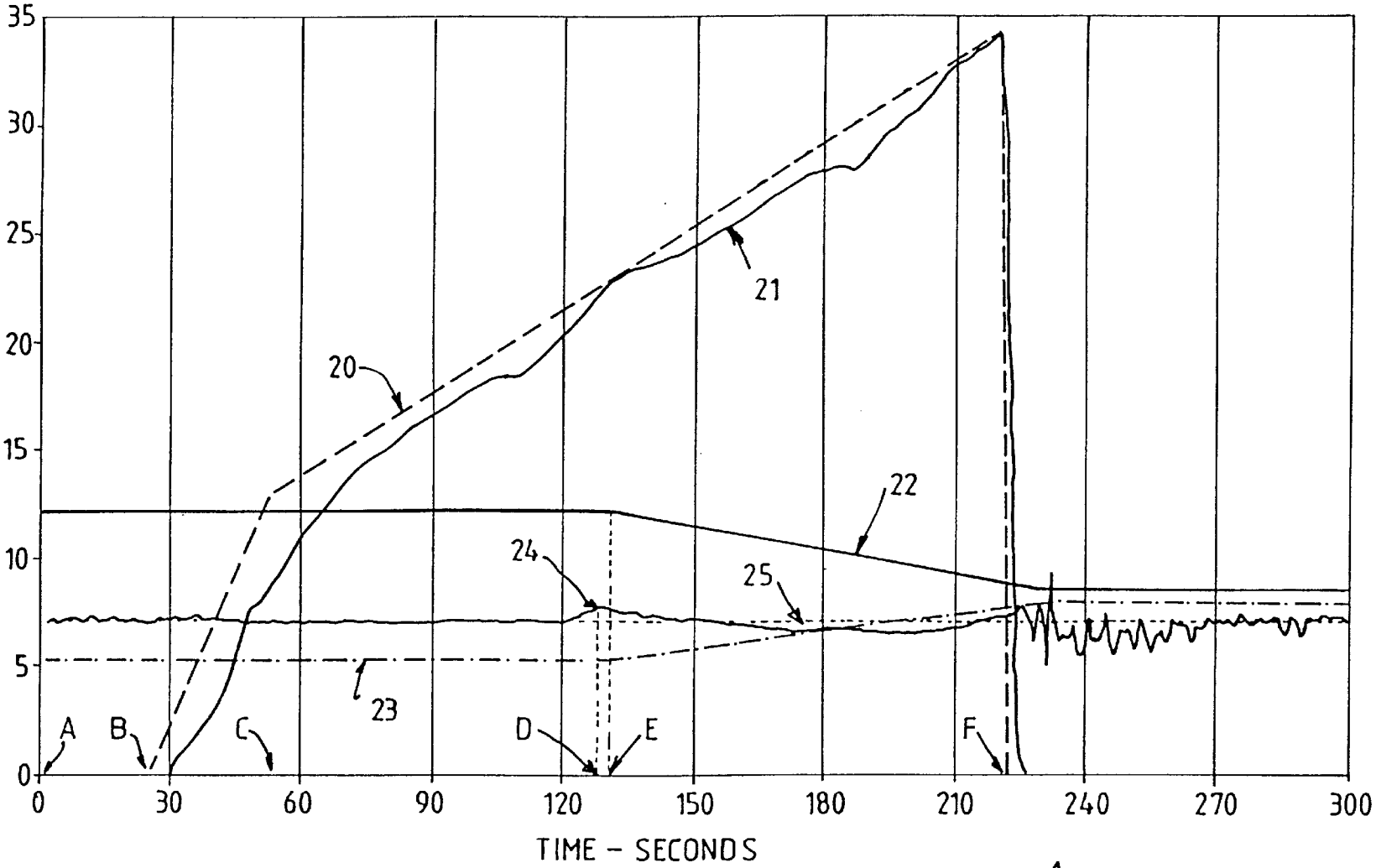
FIG. 4 is a graphic representation of the system variables during a simultaneous charging and casting operation.

Typical changes of the system variables with time are shown in FIG. 4 during a "Charging During Casting" operation. In the graphic representation, the transfer conduit vacuum set point 20 is in kPa, the transfer conduit vacuum 21, in kPa, the furnace tile angle 22 in degrees, the furnace contents level 23 in tonnes of aluminium, the launder level 24 in centimetres, and the launder level set point 25 in centimetres.

At time A, the casting operation is supplied by a tilting furnace in the usual manner.

At time B, the transfer conduit has been positioned to enable the furnace to be charged and the vacuum line opened to reduce the pressure in the transfer conduit at a fast rate to save time. At time C, before the metal in the conduit begins to weir, the vacuum set point is changed to a slower rate to avoid the conduit filling with molten metal.

At time D, the flow of metal through the conduit into the inlet well of the furnace is detected as being greater than the flow out of the launder by a rise in launder level 24. At time E, the furnace begins to lower.

At time F, a sudden loss of vacuum is detected in the conduit resulting in termination of the transfer operation.

In an alternate embodiment of the invention, a holding furnace configured for charging by the use of the conduit may be operated in a batch process. The benefits of this embodiment relate to the ability to cast the furnace to its maximum tilt limit whilst sufficient metal still remains in the charging well to prime the conduit for refilling of the furnace. The amount of metal needed for priming the conduit in this embodiment may be less than 1 tonne, compared with 5 to 20 tonnes in a conventional arrangement.

In this alternate embodiment of the invention, the major benefits arise from the use of a conduit to charge the holding furnace, resulting in significantly reduced losses due to dross formation, whilst enabling almost the full capacity of the furnace to be utilised in a batch type operation. The utilisation of as much furnace capacity as possible during batch casting operations is particularly important as it directly affects productivity.

As with the preferred embodiments, this alternative form of the invention requires that the metal in the furnace be maintained at a constant level in order to ensure that the conduit remains primed (discharge leg submerged in metal) during the charging operation. Since there is no need for very precise control of the metal level as in the preferred embodiment, a simpler method of controlling the furnace tilt may be used.

Figure 5:
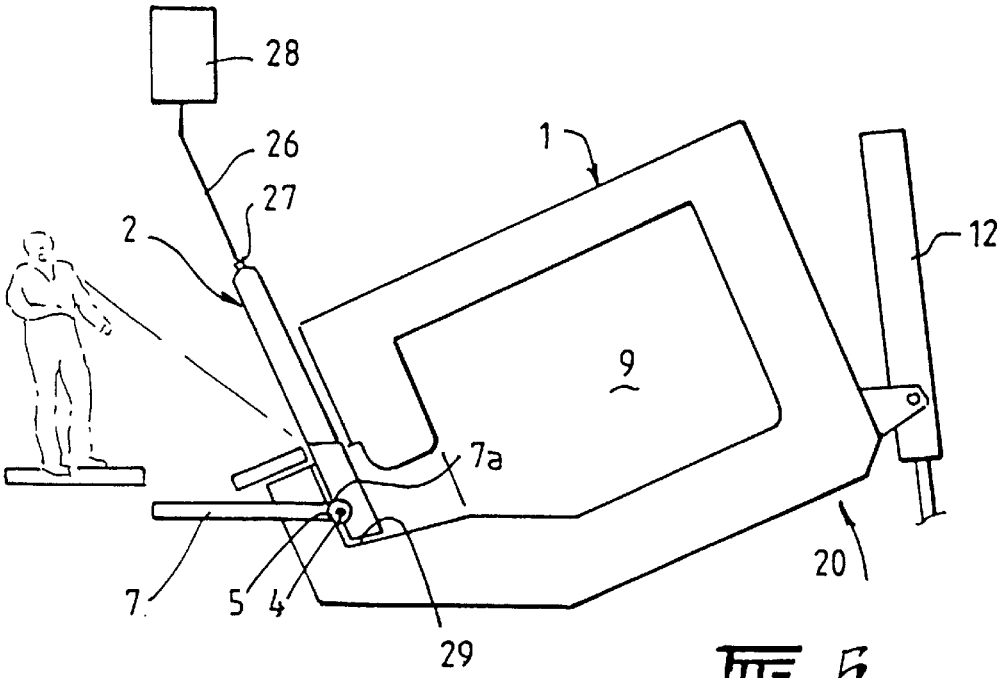
FIGS. 5 & 6 are a schematic representation of a process which is an alternative embodiment of the invention.
Figure 6:
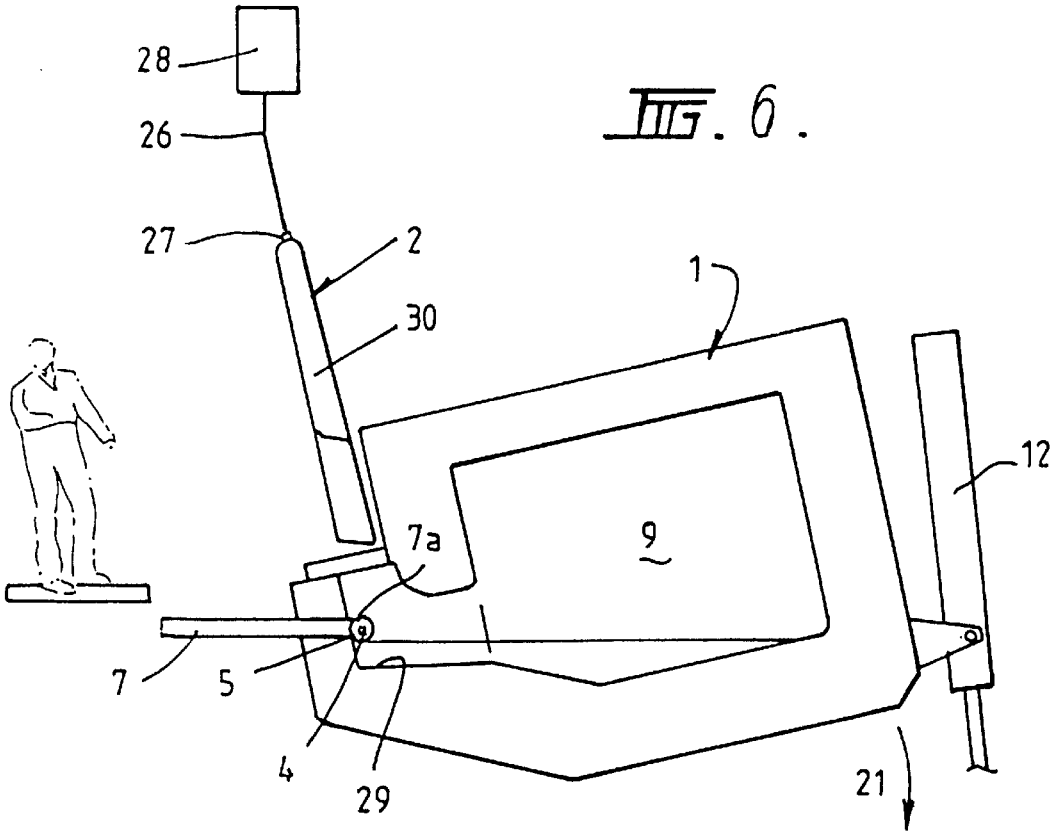

This method of furnace tilt control illustrated in FIGS. 5 & 6, does not require the use of a molten metal level sensor and does not require the molten metal to enter the casting launder, since casting is not taking place.

As shown in FIG. 5 the furnace 1 is firstly raised in the direction of arrow 20 until the molten aluminium remaining in the furnace 1 reaches a visually predetermined depth (about 50 mm below the furnace outlet 7*a*). The conduit 2 is then lowered into both the furnace 1 and the crucible 3 as previously described, such that the discharge leg 30 of the conduit in the furnace 1 is sufficiently covered to eliminate turbulence, and there is clearance beneath the pipe for unhindered metal flow. A vacuum is applied to the conduit 2 as previously described. (FIG. 6).

Upon visual determination of a rise in the metal level in the furnace 1 due to the onset of flow through the conduit 2, automatic lowering of the furnace 1 in the direction of arrow 21 is commenced by manually initiating a computer controlled sequence. (FIG. 6) The effect of this sequence is to cause the furnace 1 to be lowered such that as metal flows into the metal chamber 9 of the furnace 1, the metal level in the furnace remains constant. The computer control sequence includes a "model" of the furnace refractory profile. This model consists of a table of values which relates furnace contents to furnace tilt angle and based on an assumed flow through the transfer conduit 2, a rate of tilt is calculated and translated to an appropriate opening of the hydraulic tilt control valve. The actual tilt angle is constantly compared with a target value after a small time interval and the hydraulic control valve adjusted to converge on the target value during the next time interval.

Termination of metal transfer occurs when a sudden loss of vacuum is detected by the pressure transducer as for the preferred embodiment.

At this point, (FIG. 6) the conduit is removed and the whole charging operation repeated until the furnace is full, whence it can be used for casting in the conventional manner.

I claim:

1. An apparatus for a supply of molten metal including a holding furnace pivotable about an axis having a metal chamber for holding molten metal, an outlet for supplying molten metal from said metal chamber and an inlet well communicating with said metal chamber, said inlet well being positioned on the pivot axis of the holding furnace and displaced along the pivot axis from said outlet, a charging means for intermittently supplying a controlled flow of molten metal to the inlet well of the holding furnace, and a control means for varying the degree of pivot of the holding furnace to maintain a predetermined supply of molten metal.

2. The apparatus for the supply of molten metal according to claim 1 wherein the outlet is positioned on the pivot axis of the holding furnace.

3. The apparatus for the supply of molten metal according to claim 2 further including a launder, said outlet supplying molten metal to said launder.

4. The apparatus for the supply of molten metal according to claim 3 wherein the holding furnace is provided with a tilt hoist for raising or lowering one side of the holding furnace causing the furnace to tilt about the pivot axis.

5. The apparatus for the supply of molten metal according to claim 4 wherein the control means includes a control device which continuously monitors a signal from a level sensor in the launder, said control device causing the tilt hoist to adjust the angle of tilt of the holding furnace.

6. The apparatus for the supply of molten metal according to claim 1 wherein the charging means is a transfer conduit supplying molten metal from a removable supply vessel.

7. The apparatus for the supply of molten metal according to claim 6 wherein the conduit is an inverted U-shape defining a receiving leg and a discharge leg, said receiving leg being shorter than the discharge leg.

8. The apparatus according to claim 7 wherein the conduit is provided with a pressure tapping for connection to a vacuum line, the flow of molten metal from the removable supply vessel to the inlet well being controlled by the level of vacuum in said conduit.

9. A holding furnace for the supply of molten metal including a tilt hoist for pivoting the furnace about a pivot axis through a range of motion, a metal chamber for holding molten metal, an outlet for supplying molten metal from said metal chamber, said outlet being positioned on the pivot axis, and an inlet well for intermittently receiving molten metal from a molten metal source, said inlet well communicating with said metal chamber to enable molten metal to flow to said metal chamber and being positioned on the pivot axis of the holding furnace, displaced along the pivot axis from the outlet of the metal chamber.

10. The holding furnace according to claim 9 wherein at least a portion of the inlet well remains below the level of molten metal in the metal chamber throughout said range of motion of the holding furnace.

11. The holding furnace according to claim 9 wherein a flow rate through the outlet is determined by a rate of tilt of the holding furnace.

12. A method of supplying molten metal including the steps of, providing a holding furnace for molten metal tiltable about a pivot axis through a range of motion, tilting said holding furnace about the pivot axis to supply molten metal from an outlet in the holding furnace to a launder, intermittently charging a controlled flow of molten metal to an inlet well communicating with a metal chamber in the holding furnace, said inlet well being positioned on the holding furnace on the pivot axis of the holding furnace and being axially displaced along the pivot axis from the outlet of the holding furnace, and controlling the tilting of the holding furnace to maintain the level of molten metal in the launder at a predetermined level.

13. The method of supplying molten metal according to claim 12 wherein at least a portion of the inlet well is below the level of molten metal in the metal chamber of the holding furnace throughout a full range of pivotal movement of the holding furnace.

14. The method of supplying molten metal according to claim 12 wherein the tilting of the holding furnace is controlled by monitoring the level of molten metal in the launder and adjusting the tilt angle of the furnace to control the flow of molten metal through said outlet into the launder to maintain a predetermined level of molten metal in the launder.

15. The method of supplying molten metal according to claim 12 wherein the molten metal is charged into the inlet well of the holding furnace from a crucible, the level of molten metal in the crucible being above the level of molten metal in the inlet well and the molten metal being transferred from the crucible to the inlet well by a conduit.

16. The method of supplying molten metal according to claim 15 wherein the conduit has an inverted U-shape having a receiving leg and a discharge leg, the receiving leg being shorter than the discharge leg.

17. The method of supplying molten metal according to claim 16 wherein the receiving leg of the conduit is lowered into the crucible and the discharge leg is placed into the inlet well of the holding furnace.

18. The method of supplying molten metal according to claim 17 wherein the end of the receiving leg of the conduit is submerged below the level of molten metal in the crucible and the end of the discharge leg of the conduit is submerged below the level of molten metal in the inlet well.

19. The method of supplying molten metal according to claim 18 wherein the conduit is connected to a source of vacuum, the flow rate of molten metal through the conduit being controlled by the level of vacuum in the conduit.

20. The method of supplying molten metal according to claim 19 wherein the conduit is not completely filled with molten metal.

21. The method of supplying molten metal according to claim 20 wherein the transfer conduit is aligned substantially co-planar with the pivot axis of the holding furnace, the relative position of the transfer conduit to the holding furnace being fixed during the molten metal transfer into the inlet well.

22. A method for supplying molten metal to a launder from a holding furnace tiltable about a pivot axis, said holding furnace having a metal chamber for molten metal, an outlet for supplying molten metal to a launder, and an inlet well communicating with the metal chamber, said inlet well being positioned on the holding furnace on the pivot axis of the holding furnace, said method including the steps of, raising the holding furnace to tilt said holding furnace about the pivot axis until molten metal from said metal chamber is present in the inlet well, inserting a transfer conduit into said inlet well, submerging an end of the conduit below the level of molten metal in the inlet well, charging metal through said conduit, controlling the level of molten metal in the inlet well by lowering the holding furnace to pivot said holding furnace about the pivot axis and transfer metal into the metal chamber, discontinuing the flow of metal through said conduit, raising said holding furnace to pivot the holding furnace about the pivot axis to supply molten metal from said outlet, and controlling the tilting of the holding furnace to maintain a predetermined level of molten metal in the launder.

23. The method for supplying molten metal to a launder in accordance with claim 22 wherein said conduit supplies metal from a molten metal source above the level of molten metal in the holding furnace, said conduit being curved in an inverted U-shape to define a receiving leg and a discharge leg, said receiving leg being shorter than said discharge leg, the end of the receiving leg being submerged below the level of molten metal in the molten metal source, said conduit being connected to a source of vacuum and molten metal being charged through said conduit by increasing and controlling the level of vacuum in said conduit causing molten metal to rise up the receiving leg of the conduit and flow through the discharge leg of the conduit.

24. The method for supplying molten metal to a launder according to claim 23 wherein the flow of molten metal through said conduit is discontinued when the end of the receiving leg is no longer submerged beneath the level of molten metal in the molten metal source.

25. A method for supplying molten metal to a holding furnace tiltable about a pivot axis, said holding furnace having a metal chamber for molten metal, an outlet for supplying molten metal and an inlet well communicating with the metal chamber, said inlet well being positioned on the holding furnace on the pivot axis of the holding furnace, said method including the steps of, raising the holding furnace to tilt said holding furnace about said pivot axis until the molten metal from said metal chamber is present in the inlet well, inserting a transfer conduit into said inlet well, submerging the end of the conduit below the level of molten metal in the inlet well by lowering the holding furnace thereby transferring molten metal into the metal chamber, and discontinuing the flow of metal through said conduit.

26. An apparatus for supply of molten metal including a holding furnace pivotable about an axis having a metal chamber for holding molten metal, an outlet for supplying molten metal from said metal chamber and an inlet well communicating with said metal chamber, said inlet well being positioned adjacent the pivot axis of the holding furnace and displaced along the pivot axis from said outlet, a charging means for intermittently supplying a controlled flow of molten metal to the inlet well of the holding furnace, and a control means for varying the degree of pivot of the holding furnace to maintain a predetermined supply of molten metal.

27. The apparatus for the supply of molten metal according to claim 26 wherein the outlet is positioned adjacent the pivot axis of the holding furnace.

28. A holding furnace for the supply of molten metal including a tilt hoist for pivoting the furnace about a pivot axis, a metal chamber for holding molten metal, an outlet for supplying molten metal from said metal chamber, said outlet being positioned about the pivot axis, and an inlet well for intermittently receiving molten metal from a molten metal source, said inlet well communicating with said metal chamber to enable molten metal to flow to said metal chamber and being positioned about the pivot axis of the holding furnace, displaced along the pivot axis form the outlet of the metal chamber.

29. A method of supplying molten metal including the steps of, providing a holding furnace for molten metal tiltable about a pivot axis, tilting said holding furnace about the pivot axis to supply molten metal from an outlet in the holding furnace to a launder, intermittently charging a controlled flow of molten metal to an inlet well communicating with a metal chamber in the holding furnace, said inlet well being positioned on the holding furnace adjacent to the pivot axis of the holding furnace and being axially displaced along the pivot axis from the outlet of the holding furnace, and controlling the tilting of the holding furnace to maintain the level of molten metal in the launder at a predetermined level.

30. A method for supplying molten metal to a launder from a holding furnace tiltable about a pivot axis, said holding furnace having a metal chamber for molten metal, an outlet for supplying molten metal to a launder, and an inlet well communicating with the metal chamber, said inlet well being positioned on the holding furnace adjacent to the pivot axis of the holding furnace, said method including the steps of, raising the holding furnace to tilt said holding furnace about the pivot axis until molten metal from said metal chamber is present in the inlet well, inserting a transfer conduit into said inlet well, submerging an end of the conduit below the level of molten metal in the inlet well, charging metal through said conduit, controlling the level of molten metal in the inlet well by lowering the holding furnace to pivot said holding furnace about the pivot axis and transfer metal into the metal chamber, discontinuing the flow of metal through said conduit, raising said holding furnace to pivot the holding furnace about the pivot axis to supply molten metal from said outlet, and controlling the tilting of the holding furnace to maintain a predetermined level of molten metal in the launder.

31. A method for supplying molten metal to a holding furnace tiltable about a pivot axis, aid holding furnace having a metal chamber for molten metal, an outlet for supplying molten metal and an inlet well communicating with the metal chamber, said inlet well being positioned on the holding furnace adjacent to the pivot axis of the holding furnace, said method including the steps of, raising the holding furnace to tilt said holding furnace about said pivot axis until the molten metal from said metal chamber is present in the inlet well, inserting a transfer conduit into said inlet well, submerging the end of the conduit below the level of molten metal in the inlet well by lowering the holding furnace thereby transferring molten metal into the metal chamber, and discontinuing the flow of metal through said conduit.

* * * * *

UNITED STATES PATENT AND TRADEMARK OFFICE

CERTIFICATE OF CORRECTION

PATENT NO. : 5,812,587

DATED : September 22, 1998

INVENTOR(S) : Locatelli

It is certified that error appears in the above-identified patent and that said Letters Patent is hereby corrected as shown below:

On the title page:

Item [30], delete "Austria" insert therefor -- Australia --

Signed and Sealed this

Twenty-ninth Day of December, 1998

*Attest:*

Bruce Lehman

BRUCE LEHMAN

*Attesting Officer*

*Commissioner of Patents and Trademarks*